US006705741B2

(12) United States Patent
Bonnema et al.

(10) Patent No.: US 6,705,741 B2
(45) Date of Patent: Mar. 16, 2004

(54) SUSPENDED LIGHT SOURCE HOLDER FOR A JACK-O-LANTERN

(75) Inventors: Andrew T. Bonnema, Toronto (CA); Albert A. McKay, Stoney Creek (CA)

(73) Assignee: 2003703 Ontario Inc., Toronto (CA)

( * ) Notice: Subject to any disclaimer, the term of this patent is extended or adjusted under 35 U.S.C. 154(b) by 54 days.

(21) Appl. No.: 09/972,990

(22) Filed: Oct. 10, 2001

(65) Prior Publication Data

US 2003/0067770 A1 Apr. 10, 2003

(51) Int. Cl.[7] ..... F21V 19/00

(52) U.S. Cl. ..... 362/186; 362/191; 362/161; 362/372; 362/382

(58) Field of Search ..... 362/806, 808, 362/154, 184, 161, 240, 249, 186, 253, 122, 191

(56) References Cited

U.S. PATENT DOCUMENTS

2001/0036069 A1 * 11/2001 Franks ..... 362/122

* cited by examiner

*Primary Examiner*—Sandra O'Shea
*Assistant Examiner*—Bao Q Truong
(74) *Attorney, Agent, or Firm*—Patrick J. Hofbauer

(57) ABSTRACT

A suspended light source holder for an organic jack-o-lantern, with a light source holder removably positionable within the interior of the organic jack-o-lantern, and with a securing portion for securing the suspended light source holder to the top of the organic jack-o-lantern.

34 Claims, 6 Drawing Sheets

SUSPENDED LIGHT SOURCE HOLDER FOR A JACK-O-LANTERN

FIELD OF THE INVENTION

The present invention relates to a device for anchoring, or securing, a light source to a substrate, and more particularly, it relates to a suspended light source holder for a hollowed-out organic pumpkin, or jack-o-lantern.

BACKGROUND OF THE INVENTION

With millions upon millions of pumpkins being sold each year to home-owners and trick-or-treaters throughout the world, jack-o-lanterns are perhaps the best known symbol of Halloween. Classic jack-o-lanterns are lanterns made of a pumpkin or other vegetable, having been prepared so as to show, for example, features of a human face in illumination. The tradition of hollowing-out and carving a pumpkin to form a jack-o-lantern, and lighting it from within, is one that hearkens back hundreds of years to Irish folklore and to the story of a disreputable and immoral blacksmith named Jack, whose notorious propensity for the drink was surpassed only by his penchant for playing mean-spirited practical jokes. Legend has it that Jack even played a trick or two on the devil himself, such that, on dying, Jack was allowed entrance to neither heaven nor hell. The story goes that Jack was instead doomed to wander for eternity in the grey darkness of limbo, with only a burning ember to light his way; the ember was placed inside a hollowed-out turnip to maintain its light on his unending journey. The first fearful believers in Jack's eternal plight carved similar lanterns out of turnips and beets, and placed lit candles therewithin to ward off evil spirits. Over the years, the tradition has evolved and, while jack-o-lanterns are most commonly carved from pumpkins nowadays, they remain one of the spookiest and most chilling images to greet a young trick-or-treater travelling door to door on Halloween. Of course, with the advent of the jack-o-lantern as a prominent symbol of Halloween, there has been an increasing demand to safely provide for the proper illumination thereof.

Typically, in order to form a jack-o-lantern from a self-harvested or store-bought organic pumpkin, a user will use a pointed knife to carve a continuous circuit through an outer surface of a top portion of the pumpkin, circumscribing a selectively removable lid portion of the top portion and defining a corresponding aperture in the top portion of the pumpkin. The lid portion is then removed and a mass of pumpkin pulp and seeds contained therewithin is withdrawn, either by hand or using a spoon or other utensil, through the corresponding aperture in the top portion of the pumpkin. Having so hollowed out the pumpkin, the pointed knife is then utilized to carve a desired visage or other image into the outer surface of the pumpkin, removing any interstitial pieces therefrom. With the jack-o-lantern thus formed, a light source may then be positioned within same to provide for its illumination.

Historically, a lit candle positioned on an inside bottom surface of the jack-o-lantern has been the most common way of illuminating same, but use of the candle in this manner has inherent problems. For one, every pumpkin has a raised mound located on its inside bottom surface, also known as a bloom point, making it very hard to securely balance a candle in position thereon. This difficulty in securely balancing the candle on the bloom point leads to a significant possibility that the candle may become overturned, posing a serious risk of fire in the event that the candle is, or was, lit.

Numerous methods and devices have been developed to illuminate the jack-o-lantern by securely positioning candles at the bloom point thereof, such as, for example, using a considerable quantity of melted wax dripped directly on the inside bottom surface in substantially surrounding relation to the candle, such that the wax effectively affixes the candle to the jack-o-lantern on hardening. According to another similar method commonly used for this purpose, the candle is secured in hardened wax on an appropriately sized plate, which plate and candle are then placed on the inside bottom surface of the jack-o-lantern. However, after Halloween has ended and the jack-o-lantern has been disposed of, it can be very difficult for a user to clean the hardened wax from the plate. Furthermore, these last two methods both suffer from a common problem, in that the candles tend to become precarious and/or detached when the jack-o-lantern is moved or when, after the candle is lit, the hardened wax securing the candle to the jack-o-lantern softens due to heat from the candle's flame.

Examples of devices that have been developed to illuminate the jack-o-lantern by securing the candle to the inside bottom surface can be seen in U.S. Pat. No. 4,955,807 (Chance et al.) for a Spiral Coil Candle Holder for Pumpkins and Other Substrates, and in U.S. Pat. No. 6,106,279 (Hedlund) for a Candle Holder for Jack-O-Lantern. The Chance patent discloses a spiral coil candle holder which may embedded into the inside bottom surface of the jack-o-lantern in a corkscrew-like manner. A first problem with the Chance patent is that the spiral coil candle holder described therein is susceptible to torque forces generated when moving the jack-o-lantern. As well, the corkscrew-like motion described in the Chance patent for affixing the candle holder to the jack-o-lantern is highly inefficient and requires the expenditure of a significant amount of time and effort on the part of the user. The Hedlund patent overcomes these problems, and discloses a candle holder of a hemispherical shape, being modelled after the configuration of the top portion of a generic pumpkin. The Hedlund candle holder defines a hollow interior portion, so as to accommodate the bloom point when one or more anchors of the candle holder are embedded straight into the inside bottom surface of the jack-o-lantern.

In addition to the various individual problems so far discussed, however, there is a problem that is common to all of the above-referenced methods and devices for illuminating the jack-o-lantern by mounting the candle on the inside bottom surface thereof, including the traditional precarious balancing of the candle on the bloom point, the wax methods described above, and both the Chance patent and the Hedlund patent. Specifically, in attempting either to light a candle positioned on the inside bottom surface of the jack-o-lantern, or to position a lit candle thereon, either with or without a supporting candle holder, there is a significant risk of injury and burn to a hand, wrist, and forearm of a user. This risk of injury is made even greater by the customary sizing of the lid portion and the corresponding aperture in the top portion of the jack-o-lantern, which aperture typically provides little more than the minimum necessary clearance for passage therethrough of a hand carrying the lit candle, match, or lighter. Further, because the aperture is typically located immediately above the position for the lit candle on the inside bottom surface of the jack-o-lantern, it is necessary for the user, having so placed or lit the candle, to withdraw his or her hand from within the jack-o-lantern, through the aperture, along a path that crosses the rising heat waves immediately above the cone of the candle's flame, thus still further risking a burn injury. As well, lighting a candle that is already positioned on the inside bottom surface of the jack-o-lantern can be very awkward and difficult, requiring a significant expenditure of time and effort on behalf of the user.

Lastly, all of the methods and devices so far described for illuminating jack-o-lanterns from within are subject to an additional problem. That is, because interstitial pieces are removed from the carved image in the outer surface of the pumpkin, there is a significant risk that the lit candle positioned within the jack-o-lantern may be extinguished by an errant autumn wind.

The primary object of the invention is to provide a suspended light source holder for a jack-o-lantern that aids in preventing injury and burns that may be sustained by a user while lighting a candle, or while positioning a lit candle, within the jack-o-lantern.

Another object of the invention is to provide a suspended light source holder for a jack-o-lantern that facilitates the lighting of the candle positioned within the jack-o-lantern, as well as the positioning of the lit candle within same.

A further object of the invention is to provide a suspended light source holder for a jack-o-lantern that reduces the risk of fire.

A still further object of the invention is to provide a suspended light source holder for a jack-o-lantern that securely engages the jack-o-lantern.

A still further object of the invention is to provide a suspended light source holder for a jack-o-lantern that securely engages the light source.

A yet still further object of the invention is to provide a suspended light source holder for a jack-o-lantern that is heat resistant.

Another object of the invention is to provide a suspended light source holder for a jack-o-lantern that facilitates the changing of the light source.

Yet another object of the invention is to provide a suspended light source holder for a jack-o-lantern that, together with the light source, provides for the effective illumination of the jack-o-lantern from within.

Still yet another object of the invention is to provide a suspended light source holder for a jack-o-lantern that does not require extensive clean-up on removal from the jack-o-lantern.

An additional object of the invention is to provide a suspended light source holder for a jack-o-lantern that reduces the risk of the candle or other light source being untimely extinguished.

Another object of one aspect of the invention is to provide a suspended light source holder for a jack-o-lantern that will maintain a candle in substantially upright relation, even accommodating jack-o-lanterns with uneven or crooked top portions.

Another object of the invention is to provide a suspended light source holder for a jack-o-lantern that has a durable and reliable construction.

Yet another object of the invention is to provide a suspended light source holder for a jack-o-lantern that is easy to use and inexpensive to manufacture.

SUMMARY OF THE INVENTION

There is thus provided, according to one aspect of the invention, a suspended light source holding apparatus for a non-artifical jack-o-lantern having a top integument portion, said apparatus comprising a light source holding portion positionable within the interior of the jack-o-lantern, and means for removablely securing said light source holding portion to the top integument portion of the non-artificial jack-o-lantern by way of frictional engagement of said securing means with said too integument portion from said interior without extension of said apparatus through said too intgument portion of said non-artificial jack-o-lantern to the exterior of said jack-o-lantern.

According to another aspect of the invention, the suspended light source holder further comprises means for spacing said light source holding portion in suspended spaced relation from the top integument portion of the jack-o-lantern, below said securing means.

According to another aspect of a first embodiment of the invention, said spacing means comprises three rigid leg members, with each of said three rigid leg members having a leg upper end portion adjacent said securing means, and a leg lower end portion adjacent said light source holding portion. In said first embodiment, the securing means comprises three barb members, with each of said three barb members in substantially juxtaposed relation with said leg upper end portion of a respective one of said three rigid leg members. Also in the first embodiment, the securing means further comprises three barb limit members, with each of said three barb limit members respectively positioned between each of said three barb members and said leg upper end portion of said respective one of said three rigid leg members.

According to another aspect of a second and a third embodiment of the invention, said spacing means comprises a first swivel member and two rigid leg members positioned in substantially load balanced equilibrium with said light source holding portion, with said first swivel member adjacent said securing means, and with each of said two rigid leg members having a leg upper end portion adjacent said first swivel member and a leg lower end portion adjacent said light source holding portion. Also in said second and said third embodiment, said securing means comprises a second mating swivel member engaging said first swivel member in fastened pivoting relation, and a barb member in substantially juxtaposed relation with said second mating swivel member. Said securing means of said second and said third embodiment also has a heat shield member interposed between said barb member and said second mating swivel member. In said second and said third embodiment of the invention, said first swivel member comprises a catch member, such as, for example, an eye member and said second mating swivel member comprises a hook member.

According to a further aspect of said first and said second embodiments of the invention, the light source holding portion is shaped so as to define a recessed light securing portion, said recessed light securing portion comprising a bottom surface that is shaped so as to define an aperture therethrough. According to a still further aspect of said first and said second embodiments of the invention, said spacing means further comprises a selectively openable and closable non-opaque windscreen member.

According to another aspect of said third embodiment of the invention, said light source holding portion comprises a first light source securing member and a second light source securing member, with each of said two rigid leg members engaging a different one of said first light source securing member and said second light source securing member. Also in said third embodiment, each of said first light source securing member and said second light source securing member is respectively substantially circular in shape.

According to a further aspect of said third embodiment of the invention, each of said first and said second light source securing members is shaped so as to define a recessed light securing portion, said recessed light securing portion comprising a bottom surface that is shaped so as to define an aperture therethrough. According to a still further aspect of said third embodiment of the invention, each of said first and second light source securing members respectively further comprises selectively openable and closable non-opaque alternate windscreen member, with each said alternate windscreen member being respectively positioned in substantially circumferential relationship around a respective one of said first and second light source securing members.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
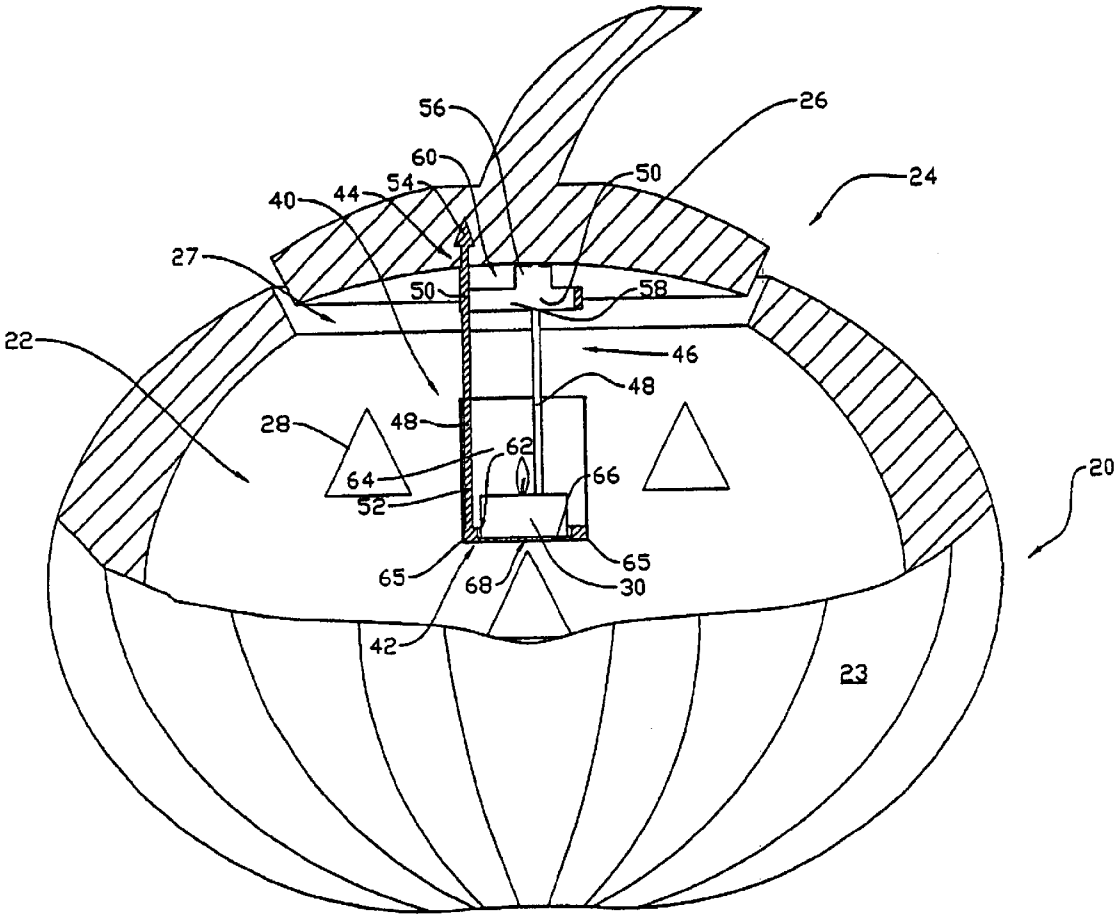
FIG. 1 is a rear elevational view of a first embodiment of a suspended light source holder for a jack-o-lantern according to the invention, attached to the jack-o-lantern, with the suspended light source holder shown in medial cross-section and the jack-o-lantern shown in partial cross-section.
Figure 2:
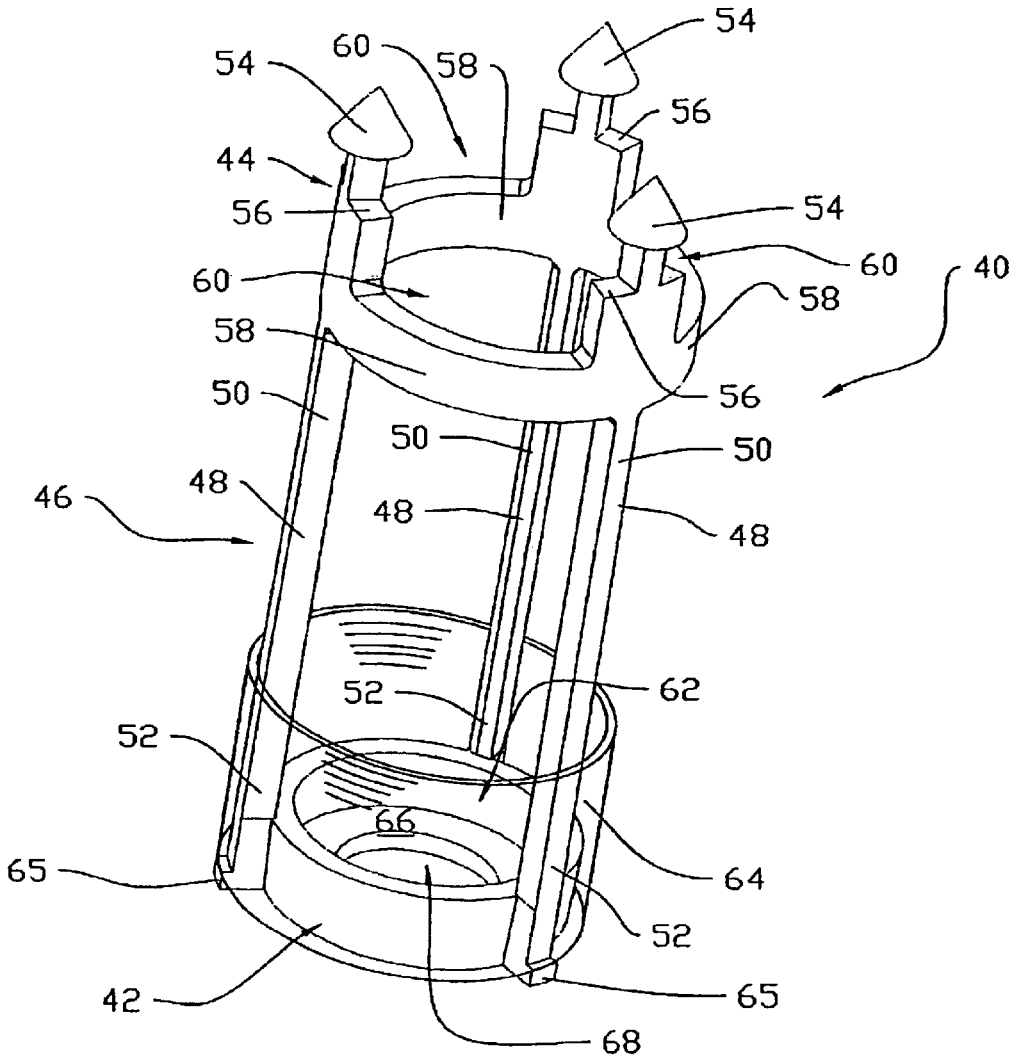
FIG. 2 is a perspective view of the suspended light source holder for a jack-o-lantern of FIG. 1, shown removed from the jack-o-lantern.

Referring now to FIGS. 1 and 2 of the drawings, there is shown a first embodiment of a suspended light source holder 40 for a jack-o-lantern 20 according to the invention. In FIG. 1, the suspended light source holder 40 according to the first embodiment is shown attached to the jack-o-lantern 20, and will be seen to comprise a light source holding portion 42 removably positionable within an interior 22 of the jack-o-lantern 20, and means 44 for securing said suspended light source holder 40 to a top portion 24, being a top integument portion, of the jack-o-lantern 20. More specifically, in FIG. 1, the securing means 44 is attached to a selectively removable lid portion 28 of the top portion 24 of the jack-o-lantern 20.

The light source holding portion 42 is of a generally planar configuration. As can be seen in FIG. 2, the light source holding portion 42 is substantially circular in shape, and is shaped so as to define a recessed light securing portion 62 having a bottom surface 66 that is shaped so as to define an aperture 68 therethrough. The recessed light securing portion 62 is adapted to hold a candle member 30 in fixed upright relation on said bottom surface 66 above said aperture 68. The recessed light securing portion 62 securely engages said candle member 30, such that said candle member 30 is not precarious nor liable to become detached from the suspended light source holder 40 when the jack-o-lantern 20 is moved, thus reducing the risk of fire that may otherwise be occasioned thereby.

The suspended light source holder 40 further comprises means 46 for spacing said light source holding portion 42 in suspended spaced relation from the top portion 24 of the jack-o-lantern 20 below said securing means 44. The spacing means 46 comprises three rigid leg members 48, with each of said three rigid leg members 48 having a leg upper end portion 50 adjacent said securing means 44, and a leg lower end portion 52 adjacent said light source holding portion 42. The three rigid leg members 48 are elongate, each defining an individual leg axis. Each said individual leg axis is oriented substantially perpendicular to said generally planar configuration of said light source holding portion 42.

The securing means 44 comprises three barb members 54, with each of said three barb members 54 being in substantially juxtaposed relation with said leg upper end portion 50 of a respective one of said three rigid leg members 48. Each of the three barb members 54 has a point that pierces the lid portion 26 of the jack-o-lantern 20, and a relatively sharp opposing projection that secures the suspended light source holder 40 and each of the three barb members 54 in place, once they are embedded in the lid portion 26. The securing means 44 further comprises three barb limit members 56, with each of said three barb limit members 56 respectively positioned between each of said three barb members 54 and said leg upper end portion 50 of said respective one of said three rigid leg members 48.

The spacing means 46 further comprises an upper strengthening band member 58 positioned in a first substantially circumferential relationship around said three rigid leg members 48, such that a notional plane bisecting said upper strengthening band member 58 into two congruent circumferentially complete rings is substantially parallel to said generally planar configuration of said light source holding portion 42. The upper strengthening band member 58 is positioned relative to said three rigid leg members 48 so as to define three vents 60 above said upper strengthening band member 58 and below said three barb limit members 56.

The spacing means 46 further comprises a selectively openable and closable non-opaque windscreen member 64 positioned below said upper strengthening band member 58 in a second substantially circumferential relationship around said three rigid leg members 48, resting on a windscreen supporting member 65 of said light source holding portion 42. As well, as best seen in FIG. 2, the windscreen supporting member 65 of the first embodiment of the suspended light source holder 40 is formed in the shape of three tab members extending radially from the light source holding portion 42. The non-opaque windscreen member 64 is shown in a closed configuration in FIGS. 1 and 2, and is designed to protect a flame of said candle member 30 from being unexpectedly extinguished by a wind or breeze passing through a carved design 28 shaped in an outer surface 23 of the jack-o-lantern 20. In this manner, the suspended light source holder 40 reduces the risk of the candle member 30 being untimely extinguished. The non-opaque windscreen member 64 is preferably constructed from any of a number of glass or plastics materials, provided the materials selected are sufficiently heat resistant for the application, and that they are either transparent or translucent. The non-opaque windscreen member 64 may be of any color or patterned combination of colors.

In use, to securely attach the first embodiment of the suspended light source holder 40 to the jack-o-lantern 20, the selectively removable lid portion 26 of the top portion 24 is withdrawn from a corresponding aperture 27 shaped in the top portion 24 of jack-o-lantern 20. The three barb members 54 of the suspended light source holder 40 are then pushed into an inner surface of the lid portion 26, until the barb limit members 56 contact same, so as to securely embed the barb members 54 therein.

With the barb members 54 and the suspended light source holder 40 so attached to the lid portion 26, the windscreen member 64 may then be moved from a closed configuration (as illustrated in FIGS. 1 and 2) to an open configuration (not shown) by sliding it, in its second substantially circumferential relationship around said three rigid leg members 48, away from said windscreen supporting member 65 towards said upper strengthening band member 58. With the windscreen member 64 in the open configuration, and with the lid portion 26 removed from the corresponding aperture 27, a user may use his or her hand to easily position said candle member 30 in fixed upright relation on said bottom surface 66 of said recessed light securing portion 62 of said light source holding portion 42, above said aperture 68.

Figure 3:
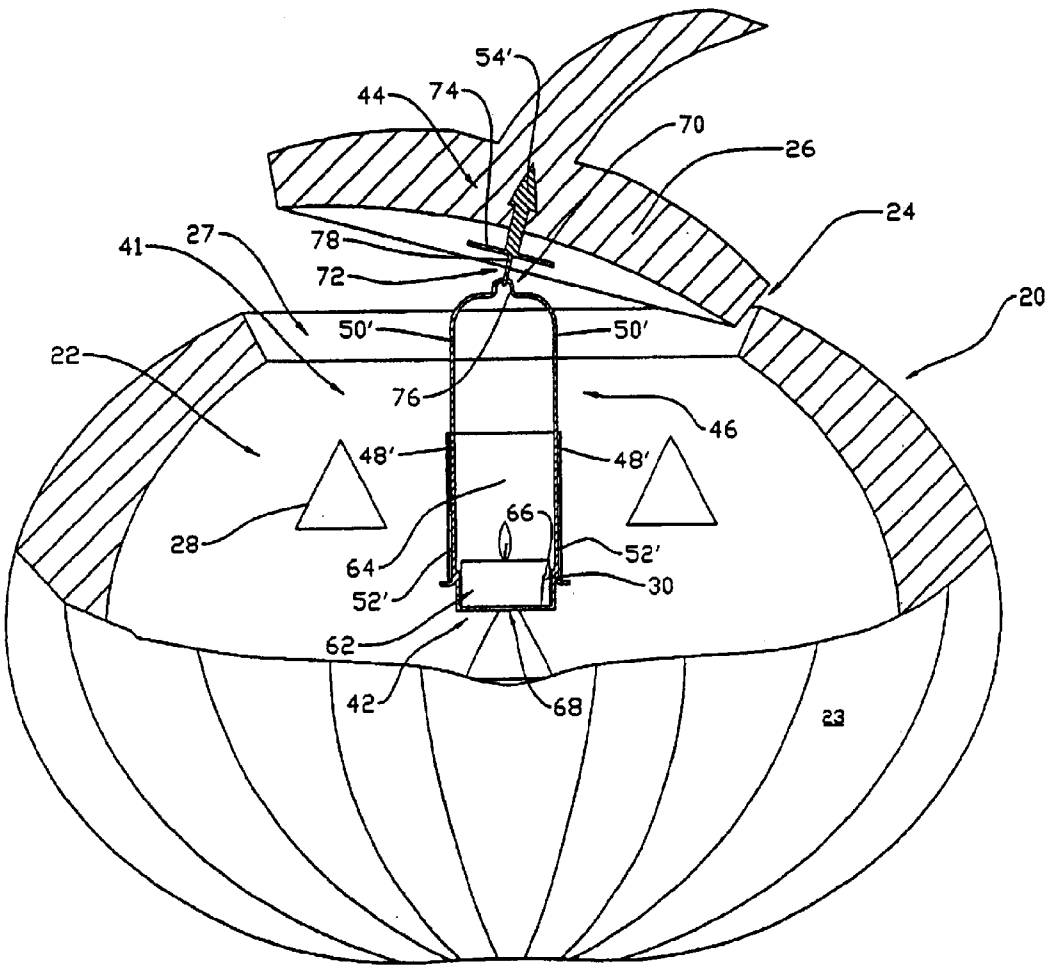
FIG. 3 is a rear elevational view of a second embodiment of a suspended light source holder for a jack-o-lantern according to the invention, attached to the jack-o-lantern, with the suspended light source holder shown in medial cross-section and the jack-o-lantern shown in partial cross-section.
Figure 4:
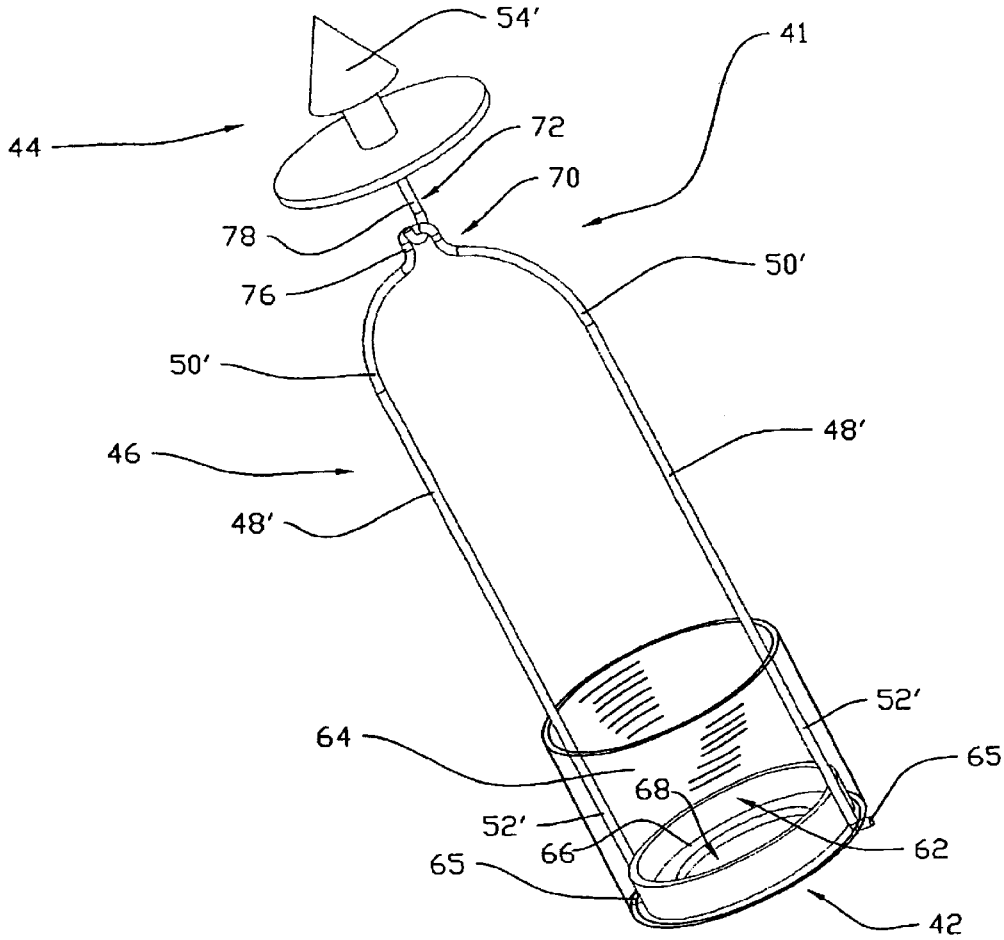
FIG. 4 is a perspective view of the suspended light source holder for a jack-o-lantern of FIG. 3, shown removed from the jack-o-lantern.

Referring now to FIGS. 3 and 4 of the drawings, there is shown a second embodiment of a suspended light source holder 41. It is to be noted that, in FIGS. 3 and 4, the same reference numerals have been used to indicate objects, surfaces, and components, which are common to both the first embodiment and the second embodiment. The second embodiment 41 differs from the first embodiment of the suspended light holder 40 in that, said spacing means 46 comprises a first swivel member 70 and two rigid leg members 48', with said first swivel member 70 adjacent said securing means 44, and with each of said two rigid leg members 48' having a leg upper end portion 50' adjacent said first swivel member 70 and a leg lower end portion 52' adjacent said light source holding portion 42. Further, in the second embodiment of the suspended light source holder 41, said securing means 44 comprises a second mating swivel member 72 engaging said first swivel member 70 in fastened pivoting relation, such that the spacing means 46, together with the light source holding portion 42, may rotate freely relative to the securing means 44 and is selectively removable therefrom. The two rigid leg members 48' are positioned in substantially load balanced equilibrium with said light source holding portion 42, such that, in use, the candle member 30 held thereon will be maintained in substantially upright relation. As well, said securing means 44 further comprises a barb member 54' in substantially juxtaposed relation with said second mating swivel member 72, but with a heat shield member 74 interposed therebetween. The heat shield member 74 is designed to shield the barb member 54' and the lid portion 26 from rising heat from the candle member 30, and it may be constructed of polished aluminum, or an industrial insulation material selected from the group consisting of flexible felt, 85% magnesia, foam glass, mineral wool, silica lime, and calcium silicate. The first swivel member 70 comprises a catch member 76, such as, for example, an eye member and, as can be seen in FIG. 4, said second mating swivel member comprises a hook member 78. Unlike the first embodiment of the suspended light source holder 40, it will be noted that the second embodiment of the suspended light source holder 41 does not have barb limit members 56, the upper strengthening band member 58, or vents 60. As well, as best seen in FIG. 4, the windscreen supporting member 65 of the second embodiment of the suspended light source holder 41 is formed in the shape of two tab members extending radially from the light source holding portion 42.

The second embodiment of the suspended light source holder 41 is securely attached to the jack-o-lantern 20 in much the same manner as is the first embodiment of the suspended light source holder 40, except for the fact that, not having a barb stopping member 56, the barb member 54' is pushed into the inner surface of the lid portion 26 only until it is securely embedded therein. Likewise, with the barb member 54' and the suspended light source holder 41 so attached to the lid portion 26, the selectively openable and closable non-opaque windscreen member 64 may then be moved from a closed configuration (as illustrated in FIGS. 3 and 4) to an open configuration (not shown) by sliding it, in its substantially circumferential relationship around said two rigid leg members 48', away from said light source holding portion 42. With the windscreen member 64 in the open configuration, and with the lid portion 26 removed from the corresponding aperture 27, a user may use his or her hand to easily position said candle member 30 in fixed upright relation on said bottom surface 66 of said recessed light securing portion 62 of said light source holding portion 42, above said aperture 68.

Figure 5:
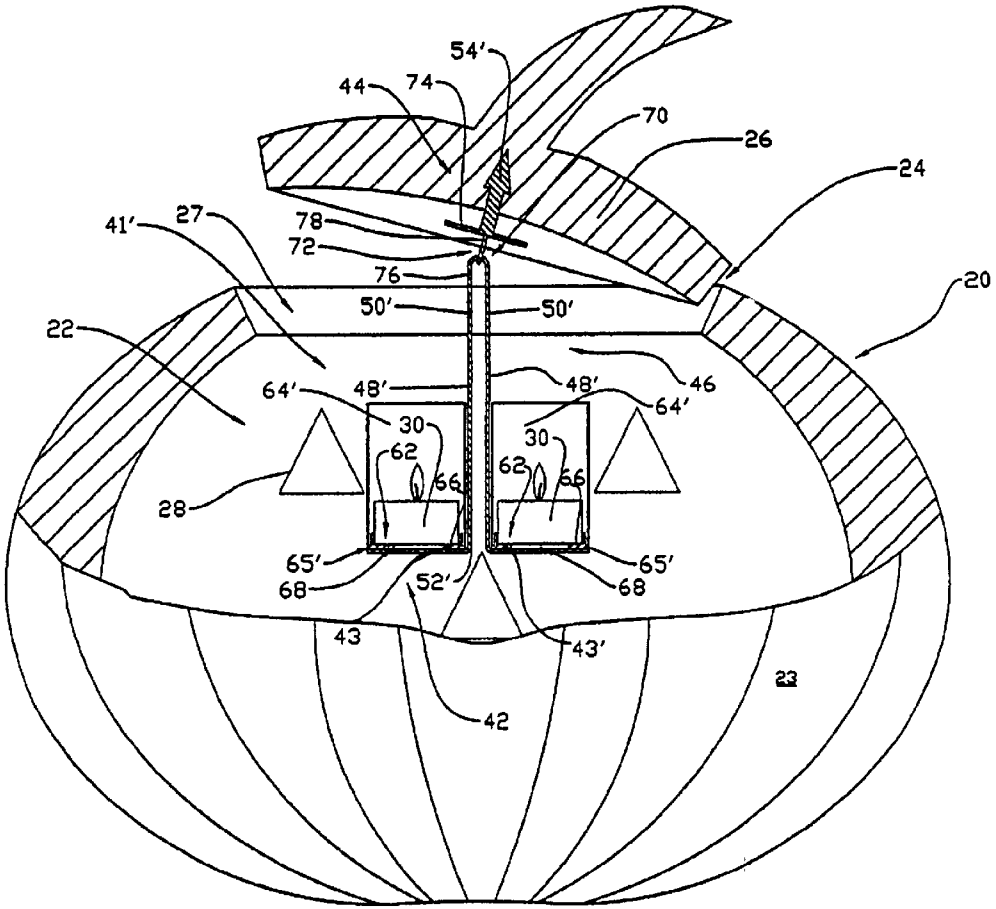
FIG. 5 is a rear elevational view of a third embodiment of a suspended light source holder for a jack-o-lantern according to the invention, attached to the jack-o-lantern, with the suspended light source holder shown in medial cross-section and the jack-o-lantern shown in partial cross-section.
Figure 6:
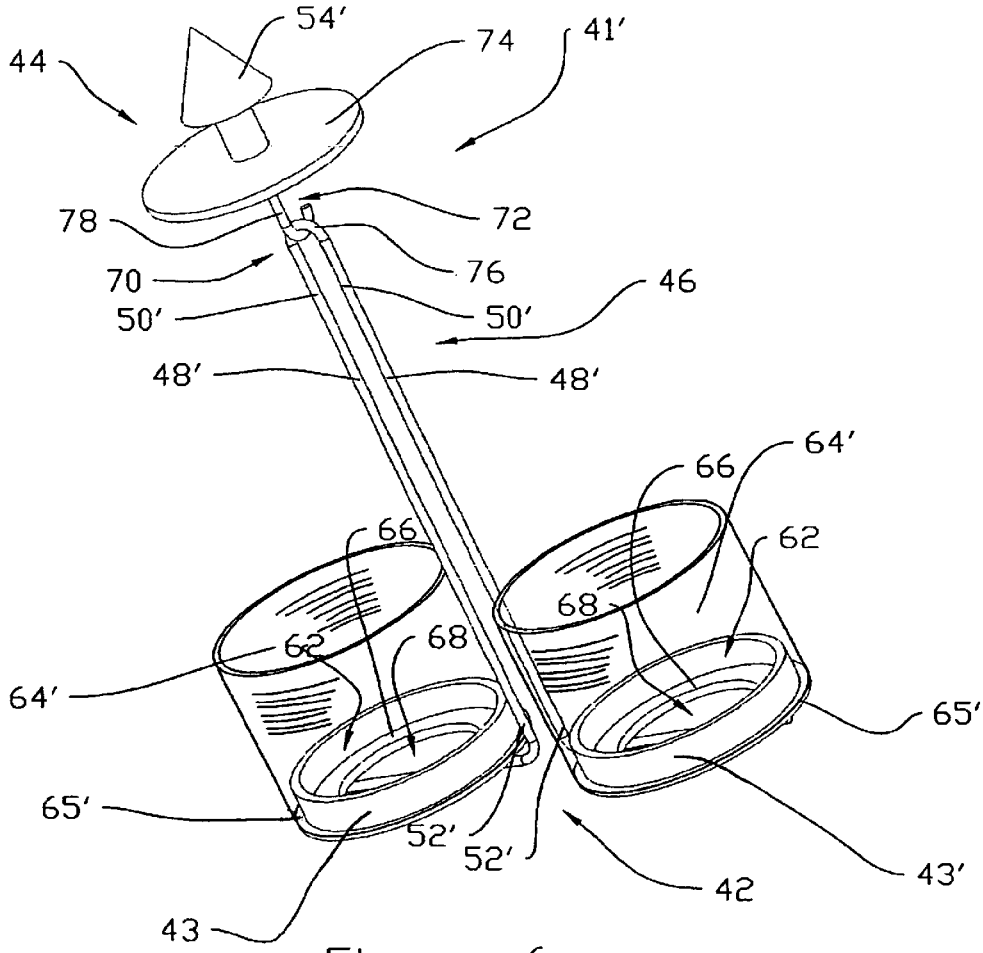
FIG. 6 is a perspective view of the suspended light source holder for a jack-o-lantern of FIG. 5, shown removed from the jack-o-lantern.

Referring now to FIGS. 5 and 6 of the drawings, there is shown a third embodiment of a suspended light source holder 41'. It is to be noted that, in FIGS. 5 and 6, the same reference numerals have been used to indicate objects, surfaces, and components, which are common to the first, second, and third embodiments. The third embodiment 41' differs from the second embodiment of the suspended light holder 41 in that said light source holding portion 42 comprises a first light source securing member 43 and a second light source securing member 43', with each of said two rigid leg members 48' engaging a different one of said first and said second light source securing members 43, 43'. Further, each of said first and second light source securing members 43, 43' is respectively substantially circular in shape and is respectively shaped so as to define said recessed light securing portion 62. As well, each of said first and second light source securing members 43, 43' respectively further comprises a selectively openable and closable non-opaque alternate windscreen member 64', with each said alternate windscreen member 64' being respectively positioned in substantially circumferential relationship around a respective one of said first and second light source securing members 43, 43', and with each said alternate windscreen member 64' resting on an alternate windscreen supporting member 65' of each said respective one of said first and second light source securing members 43, 43'. The non-opaque alternate windscreen member 64' is preferably constructed from any of a number of glass or plastics materials, provided the materials selected are sufficiently heat resistant for the application, and that they are either transparent or translucent. The non-opaque alternate windscreen member 64' may be of any color or patterned combination of colors. As best seen in FIG. 6, said alternate windscreen supporting member 65' of the third embodiment of the suspended light source holder 41' is formed in the shape of a ridge circumscribing each said respective one of said first and second light source securing members 43, 43'. It is to be noted that, unlike the first and second embodiments of the suspended light source holder 40, 41, the spacing means 46 of the third embodiment of the suspended light holder 41' is not provided with a windscreen member.

The third embodiment of the suspended light source holder 41' is securely attached to the jack-o-lantern 20 in an identical manner as is the second embodiment of the suspended light source holder 41. With the barb member 54' and the suspended light source holder 41' attached to the lid portion 26, each said alternate windscreen member 64' may be moved from a closed configuration (as illustrated in FIGS. 5 and 6) to an open configuration (not shown) by lifting each said alternate windscreen member 64', from its respective substantially circumferential relationship around said respective one of said first and second light source securing members 43, 43'. With each said alternate windscreen member 64' in the open configuration, and with the lid portion 26 removed from the corresponding aperture 27, a user may use his or her hand to easily and respectively position each said candle member 30 in fixed upright relation on said bottom surface 66 of said recessed light securing portion 62 of said respective one of said first and second light source securing members 43, 43', above said aperture 68.

In the first, second, and third embodiments, the suspended light source holder, 40, 41, and 41' respectively, is designed such that said light source holding portion 42, or said candle member 30 positioned in fixed upright relation on said bottom surface 66 of said recessed light securing portion 62, may be easily accessed from a side thereof, rather than from above. Since the user's hand need never be positioned above said candle member 30, the risk of injury or burn is greatly reduced, and the candle member 30 may safely be lit either before or after positioning it on said light source holding portion 42.

Once said candle member 30 is lit and positioned on said first, second, or third embodiment of said suspended light source holder, 40, 41, or 41' respectively, said windscreen member 64, or each said alternate windscreen member 64' as the case may be, is moved back to said closed configuration. Then, said lid portion 26 is replaced within said corresponding aperture 27 of said top portion 24 of said jack-o-lantern 20, so as to removably position said first, second, or third embodiment of said suspended light source holder, 40, 41, or 41' respectively, within an interior 22 of the jack-o-lantern 20, and so as to provide for its effective illumination from within.

In use of the second and third embodiments of the suspended light source holder, 41 and 41' respectively, each said candle member 30 held in the light source holding portion 42 will be maintained in substantially upright relation, even when the jack-o-lantern 20 has an uneven or crooked top portion 24, since the second mating swivel member 72 engages the first swivel member 70 in fastened pivoting relation and the two rigid leg members 48' are positioned in substantially load balanced equilibrium with said light source holding portion 42.

As well, the design of the third embodiment of the suspended light source holder 41' ensures that a point of contact between said barb member 54' and said lid portion 26 of the jack-o-lantern 20 will not coincide with a heat-affected zone of the lid portion 26 of the jack-o-lantern 20, the heat-affected zone being that part of the lid portion 26 typically located immediately above each said candle member 30 in a path of rising heat waves from the cone of the candle's flame. Typically, the heat-affected zone of the jack-o-lantern 20 will become somewhat cooked and mushy, shrivelling and shrinking from the candle's flame, with a resulting reduced rigidity. Accordingly, by ensuring that the point of contact between said barb member 54' and said lid portion 26 does not coincide with the heat-affected zone of the jack-o-lantern 20, the third embodiment of the suspended light source holder 41' has an increased security of engagement with the jack-o-lantern 20.

In the event that it becomes necessary to replace one said candle member 30, a user may remove said lid portion 26 of said jack-o-lantern 20 from said corresponding aperture 27 in said top portion 24, and then move said windscreen member 64, or said alternate windscreen member 64' as appropriate, to said open configuration. Thereafter, the user may insert a finger through said aperture 68 in said bottom surface 62 of said recessed light securing portion 62 of said first, second, or third embodiment of said suspended light source holder, 40, 41, or 41' respectively, to push and remove said candle member 30. A new candle member, either lit or unlit, may then be positioned in fixed upright relation on said bottom surface 66 of said recessed light securing portion 62, in exactly the same manner as detailed above. Accordingly, it can be seen that the design according to the present invention of said first, second, and third embodiments of the suspended light source holder, 40, 41, and 41' respectively, being provided with said aperture 68 in said light source holding portion 42, facilitates the changing of said candle member 30 or other light source.

After Halloween has ended, the first, second, or third embodiment of the suspended light source holder, 40, 41, or 41' respectively, may be removed from the lid portion 26 of the jack-o-lantern 20, and the jack-o-lantern 20 may be disposed of through ordinary means. In order to clean the first, second, and third embodiments of the suspended light source holder, 40, 41, and 41' respectively, the user may simply flake the hardened wax therefrom or, alternately, he or she may heat the wax until it liquefies and then simply rinse the melted wax away. Accordingly, it will be seen that the first, second, and third embodiments of the suspended light source holder, 40, 41, and 41' respectively, according to the present invention, do not require extensive clean-up.

With the exception of said windscreen member 64, each said alternate windscreen member 64', and the heat shield member 74, which are constructed as discussed above, all portions of the first, second, and third embodiments of the suspended light source holder, 40, 41, and 41' respectively, may be constructed from any of a number of metal, ceramic, or plastics materials, provided the materials selected are sufficiently heat resistant for the application. However, the construction materials for all portions of the suspended light source holder 40, 41, 41' are selected, in part, based on their heat resisting properties. Additionally, the construction materials are such as to ensure a durable and reliable construction and a design which is relatively inexpensive to manufacture.

Other modifications and alterations may be used in the design and manufacture of the according to the present invention without departing from the spirit and scope of the invention, which is limited only by the accompanying claims. For example, instead of being perpendicular to the generally planar configuration of the light source holding portion 42, the rigid leg members 48 of the first embodiment of the suspended light source holder 40 may be inclined outwards from the light source holding portion 42 to the securing means 44 to help resist against buckling when the barb members 54 are being embedded in the lid portion 26 of the jack-o-lantern 20.

In a further example, in the first embodiment, the spacing means 46 might be provided with more than three rigid leg members 48. It should be noted that, once the number of rigid leg members increases above a certain point, as determined in part by the materials of construction, it will no longer be necessary to provide each rigid leg member with a barb member having a relatively sharp opposing projection that secures the suspended light source holder 40 in place, since the forces exerted on each barb member will not be sufficient to overcome the coefficient of static friction between same and the lid portion 26 of the jack-o-lantern 20 in which they are embedded. As well, more than one barb member 54' might be utilized to secure the second and third embodiments of the suspended light source holder, 41 and 41' respectively, to the lid portion 26 of the jack-o-lantern 20, in which case, the same considerations would apply, and the necessity of having a similar relatively sharp opposing projection that secures the suspended light source holder 41, 41' in place would be obviated. Likewise, of course, it would be possible to provide the second and third embodiments of the suspended light source holder 41, 41' with more than two rigid leg members 58'.

In another example, the first embodiment of the suspended light source holder 40 may be provided with two rigid leg members, instead of three rigid leg members 58, with said two rigid leg members being positioned in substantially load balanced equilibrium with said light source holding portion 42. As well, the first and second embodiments of the suspended light source holder 40, 41 may be provided with a single rigid leg member, instead of three rigid leg members 58 and two rigid leg members 58', respectively, with the light source holding portion 42 counterbalanced to maintain the candle member 30 in substantially upright relation, such as, for example, by providing a second counterbalancing candle member, by providing a counterbalancing bend in the single leg member, or by providing a counterbalancing weight. Likewise, the third embodiment of the suspended light source holder 41' may be provided with a single rigid leg member instead of two rigid leg members 58', with the light source holding portion 42 counterbalanced to maintain each said candle member 30 in substantially upright relation, such as, for example, with said single rigid leg member engaging both of said first and second light source securing members 43, 43'.

In yet another example, the first embodiment of the suspended light source holder 40 might be provided with more than one strengthening band member, so as to define at least an upper and a lower strengthening band member. Likewise, the second and third embodiments of the suspended light source holder 41, 41' might be provided with one or more strengthening band members.

As a further example of a modification or alteration which may be used in the design of the second and third embodiments of the suspended light source holder 41, 41', a threaded member might be utilized in place of the barb member 54' to screw the securing means 44 into the lid portion 26 of the jack-o-lantern 20.

As well, the second and third embodiments of the suspended light source holder 41, 41' specify that the first swivel member 70 comprises a catch member 76 and that the second mating swivel member 72 comprises a hook member 78, but this situation may easily be reversed, such that the first swivel member 70 comprises a hook member and the second mating swivel member 72 comprises a catch member. Likewise, both the first and the second mating swivel members 70, 72 may comprise either hook or catch members, such that a hook member of the first swivel member engages a hook member of the second mating swivel member, or that a catch member of the first swivel member engages a catch member of the second mating swivel member. Likewise, the second and third embodiments of the suspended light source holder 41, 41' specify that the first swivel member 70 comprises a catch member 76 and that the second mating swivel member 72 comprises a hook member 78, but these specific pivoting structures may easily be replaced with other such structures to accomplish the same purpose. That is, for example, the first swivel member 70 may comprise a ball member and the second mating swivel member 72 may comprise a corresponding socket member, or vice versa.

As well, in the second and third embodiments of the suspended light source holder 41, 41', said second mating swivel member 72 is specified as engaging said first swivel member 70 in fastened pivoting relation, such that the spacing means 46, together with the light source holding portion 42, may rotate freely relative to the securing means 44 and is selectively removable therefrom. However, this need not necessarily be the case, and said second mating swivel member 72 may engage said first swivel member 70 in fastened pivoting relation, such that the spacing means 46, together with the light source holding portion 42, may rotate freely relative to the securing means 44 but is not selectively removable therefrom.

As a further example of a possible modification or alteration to the invention, the second and third embodiments of the suspended light source holder 41, 41' might be provided without the heat shield member 74.

Additionally, it would be possible to provide the light source holding portion 42 of both the first and the second embodiments of the suspended light source holder 40, 41 with more than one recessed light securing portion 62 to accommodate more than one candle member 30. Likewise, it would be possible to provide either or both of the first and second light source securing members 43, 43' of the third embodiment of the suspended light source holder 41' with more than one recessed light securing portion 62, such that either or both could each accommodate more than one candle member 30.

As yet another example of a modification or alteration which may be used in the design of the first, second, and third embodiments of the suspended light source holder, 40, 41, and 41' respectively, rather than providing the securing means 44 with barb members 54, 54' for insertion into the lid portion 26 of the jack-o-lantern 20, one or more jack-o-lantern securing hook members may be provided to securely engage a circumscribing edge of the aperture 27 in the top portion 24 of the jack-o-lantern 20.

Likewise, the respective rigid leg members 58, 58' of the first, second, and third embodiments of the suspended light source holder 40, 41, 41' might be adjustable in length, such as, for example, having a series of interfitting components to effect a telescopic adjustability in length.

As well, it should be noted that, while the leg members 58, 58' have been described as being rigid, they might still be formed in a chain-like structure.

In yet another example, the light source holding portion 42 of the first and second embodiments of the suspended light source holder 40, 41, and the first and second light source securing members 43, 43' of the third embodiment of the suspended light source holder 41', might be of a substantially non-circular shape, such as, for example, in the shape of a triangle, a square, or some other desirable shape.

An example of a modification or alteration which may be used in the design of the windscreen member 64 and the alternate windscreen member 64' includes designs which may be snapped in place and those having a hinge to effect said substantially circumferential relationship about said leg members 58, 58', or about each of said first and second light source securing members 43, 43' as appropriate.

In another example, the first, second, and third embodiments of the suspended light source holder, 40, 41, and 41' respectively, may be provided with a light reflecting member, possibly shaped so as to define a ventilation aperture therethrough and positioned adjacent the securing means 44, to reflect light from the candle member 30 to the carved design 28 of the jack-o-lantern 20.

As well, the first embodiment of the suspended light source holder 40 specifies that the windscreen supporting member 65 is formed in the shape of three tab members extending radially from the light source holding portion 42, but the windscreen supporting member 65 of the first embodiment may instead be formed in the shape of a ridge circumscribing the light source holding portion 42. Likewise, the windscreen supporting member 65 of the second embodiment of the suspended light source holder 41 is specified as being formed in the shape of two tab members extending radially from the light source holding portion 42, but more than two tab members might be used, or the windscreen supporting member 65 of the second embodiment may instead be formed in the shape of ridge circumscribing the light source holding portion 42. As well, each alternate windscreen supporting member 65' of the third embodiment of the suspended light source holder 41' is specified as being formed in the shape of a ridge circumscribing each said respective one of said first and second light source securing members 43, 43', but the alternate windscreen supporting member 65 of the second embodiment may instead be formed in the shape of one or more tab members extending radially from each said respective one of said first and second light source securing members 43, 43'.

Of course, the first, second, and third embodiments of the suspended light source holder, 40, 41, and 41' respectively, may be used in association with light sources other than the candle member 30, such as, for example, one or more powered light sources or powered light sources having multi-colored lenses or light bulbs.

We claim:

1. A suspended light source holding apparatus for a non-artifical jack-o-lantern having a top integument portion, said apparatus comprising;

(a) a light source holding portion positionable within the interior of the jack-o-lantern, and (b) means for removably securing said light source holding portion to the top integument portion of the non-artificial jack-o-lantern by way of frictional engagement of said securing means with said top integument portion from said interior, without extension of said apparatus through said top integument portion of said non-artificial jack-o-lantern to the exterior of said jack-o-lantern.

2. The suspended light source holder according to claim 1, further comprising means for spacing said light source holding portion in suspended spaced relation from the top integument portion of the jack-o-lantern below said securing means.

3. The suspended light source holder according to claim 2, wherein said light source holding portion is of a generally planar configuration.

4. The suspended light source holder according to claim 3, wherein said spacing means comprises one or more rigid leg members, with each of said one or more rigid leg members having a leg upper end portion adjacent said securing means, and a leg lower end portion adjacent said light source holding portion.

5. The suspended light source holder according to claim 4, wherein said securing means comprises one or more barb members, with each of said one or more barb members in substantially juxtaposed relation with said leg upper end portion of a respective one of said one or more rigid leg members.

6. The suspended light source holder according to claim 5, wherein said securing means further comprises one or more barb limit members, with each of said one or more barb limit members respectively positioned between each of said one or more barb members and said leg upper end portion of said respective one of said one or more rigid leg members.

7. The suspended light source holder according to claim 6, wherein said one or more rigid leg members comprise three rigid leg members, wherein said one or more barb limit members comprise three barb limit members, and wherein said one or more barb members comprise three barb members.

8. The suspended light source holder according to claim 7, wherein said spacing means further comprises one or more strengthening band members positioned in a first substantially circumferential relationship around said three rigid leg members, such that a notional plane bisecting a respective one of said one or more strengthening band members into two congruent circumferentially complete rings is substantially parallel to said generally planar configuration of said light source holding portion, so as to define at least an upper strengthening band member.

9. The suspended light source holder according to claim 8, wherein said upper strengthening band member is positioned relative to said three rigid leg members so as to define three vents above said upper strengthening band member and below said three barb limit members.

10. The suspended light source holder according to claim 9, wherein said light source holding portion is substantially circular in shape.

11. The suspended light source holder according to claim 10, wherein said light source holding portion is shaped so as to define a recessed light securing portion.

12. The suspended light source holder according to claim 11, wherein said spacing means further comprises a selectively openable and closable non-opaque windscreen member positioned in a second substantially circumferential relationship around said three rigid leg members, below said upper strengthening band member.

13. The suspended light source holder according to claim 12, wherein said recessed light securing portion comprises a bottom surface shaped so as to define an aperture therethrough.

14. The suspended light source holder according to claim 13, wherein said recessed light securing portion is adapted to hold a candle member in fixed upright relation on said bottom surface above said aperture.

15. The suspended light source holder according to claim 14, wherein said three rigid leg members are elongate, with each of said three rigid leg members defining an individual leg axis, with each said individual leg axis being oriented substantially perpendicular to said generally planar configuration of said light source holding portion.

16. The suspended light source holder according to claim 3, wherein said spacing means comprises one or more first swivel members and one or more rigid leg members, with said one or more first swivel members adjacent said securing means, and with each of said one or more rigid leg members having a leg upper end portion adjacent said one or more first swivel members and a leg lower end portion adjacent said light source holding portion, and wherein said securing means comprises one or more second mating swivel members engaging said one or more first swivel members in fastened pivoting relation.

17. The suspended light source holder according to claim 16, wherein said securing means further comprises one or more barb members, with each of said one or more barb members in substantially juxtaposed relation with said one or more second mating swivel members.

18. The suspended light source holder according to claim 17, wherein said securing means further comprises a heat shield member interposed between said one or more barb members and said one or more second mating swivel members.

19. The suspended light source holder according to claim 18, wherein said one or more first swivel members comprise one first swivel member, and wherein said one or more second mating swivel members comprise one second mating swivel member.

20. The suspended light source holder according to claim 19, wherein said one or more rigid leg members comprise two rigid leg members, with said two rigid leg members being positioned in substantially load balanced equilibrium with said light source holding portion.

21. The suspended light source holder according to claim 20, wherein said first swivel member comprises a catch member and said second mating swivel member comprises a hook member.

22. The suspended light source holder according to claim 21, wherein said light source holding portion is substantially circular in shape.

23. The suspended light source holder according to claim 22, wherein said light source holding portion is shaped so as to define a recessed light securing portion.

24. The suspended light source holder according to claim 23, wherein said spacing means further comprises a selectively openable and closable non-opaque windscreen member positioned in substantially circumferential relationship around said two rigid leg members, below said upper end portions.

25. The suspended light source holder according to claim 24, wherein said recessed light securing portion comprises a bottom surface shaped so as to define an aperture therethrough.

26. The suspended light source holder according to claim 25, wherein said recessed light securing portion is adapted to hold a candle member in fixed upright relation on said bottom surface above said aperture.

27. The suspended light source holder according to claim 26, wherein said two rigid leg members are elongate, with each of said two rigid leg members defining an individual leg axis, with each said individual leg axis being oriented substantially perpendicular to said generally planar configuration of said light source holding portion.

28. The suspended light source holder according to claim 21, wherein said light source holding portion comprises a first light source securing member and a second light source securing member, with each of said two rigid leg members engaging a different one of said first light source securing member and said second light source securing member.

29. The suspended light source holder according to claim 28, wherein each of said first light source securing member and said second light source securing member is respectively substantially circular in shape.

30. The suspended light source holder according to claim 29, wherein each of said first light source securing member and said second light source securing member is respectively shaped so as to define a recessed light securing portion.

31. The suspended light source holder according to claim 30, wherein each of said first light source securing member and said second light source securing member respectively further comprises a selectively openable and closable non-opaque windscreen member, with each said selectively openable and closable non-opaque windscreen member being respectively positioned in substantially circumferential relationship around a respective one of said first light source securing member and said second light source securing member.

32. The suspended light source holder according to claim 31, wherein each said recessed light securing portion respectively comprises a bottom surface shaped so as to define an aperture therethrough.

33. The suspended light source holder according to claim 32, wherein each said recessed light securing portion is respectively adapted to hold a candle member in fixed upright relation on each respective said bottom surface above each respective said aperture.

34. The suspended light source holder according to claim 33, wherein said two rigid leg members are elongate, with each of said two rigid leg members defining an individual leg axis, with each said individual leg axis being oriented substantially perpendicular to said generally planar configuration of said light source holding portion.

* * * * *